US005570594A

United States Patent [19]

Fleissner

[11] Patent Number: 5,570,594

[45] Date of Patent: Nov. 5, 1996

[54] DEVICE FOR DIRECT-FLOW TREATMENT OF FIBER-CONTAINING MATERIAL

[75] Inventor: Gerold Fleissner, Zug, Switzerland

[73] Assignee: Fleissner GmbH & Co., Egelsbach, Germany

[21] Appl. No.: 424,625

[22] Filed: Apr. 19, 1995

[30] Foreign Application Priority Data

Apr. 20, 1994 [DE] Germany ..... 44 13 779.6

[51] Int. Cl.[6] ..... D06B 5/08

[52] U.S. Cl. ..... 68/5 D; 34/123; 68/158; 68/903

[58] Field of Search ..... 68/5 D, 158, 903, 68/5 E, 184; 34/111, 122, 123, 139

[56] References Cited

U.S. PATENT DOCUMENTS 4,811,574 3/1989 Fleissner ..... 68/5 D
4,912,945 4/1990 Fleissner ..... 68/903
4,970,879 11/1990 Fleissner ..... 68/903
5,052,197 10/1991 Fleissner ..... 68/903

*Primary Examiner*—Philip R. Coe
*Attorney, Agent, or Firm*—Antonelli, Terry, Stout & Kraus

[57] ABSTRACT

A permeable drum for wet or dry treatment of textile material, paper or such permeable materials of a certain width comprises narrow sheet metal strips or narrow webs. The sheet metal strips extend in an axially parallel direction. Connector members between the sheet metal strips are aligned in the peripheral direction. The connector members, also serving as spacers, are of a one-piece design and connect to adjacent sheet metal strips. Secure connection of the spacers to the sheet metal strips is effected by screws. Radially inward beneath the inner edges of the strips is a sheet metal jacket, provided with apertures, having its axis arranged in parallel to a longitudinal axis of the permeable drum. This additional sheet metal jacket causes a certain dynamic pressure of the air flowing through the permeable drum, so that the treatment result is rendered more uniform. Furthermore, the precision of rotation of the permeable drum construction is increased.

7 Claims, 2 Drawing Sheets

DEVICE FOR DIRECT-FLOW TREATMENT OF FIBER-CONTAINING MATERIAL

BACKGROUND OF THE INVENTION

This invention relates to an improved device for direct-flow treatment of fiber-containing material, e.g., textiles, fleeces or paper by a gaseous or liquid treatment agent circulated in the device, with a transport member comprising a fluid permeable drum having non-permeable bases on its ends and being under suction draft, said transport member being covered on its periphery with a screen-like covering, sheet metal strips extending rectilinearly and unbent from base to base between the bases of the drum, the widths of said strips extending in a radial direction, one-piece connector members which are uniformly disposed between the sheet metal strips over the length of the drum, and which are formed of a width corresponding to the required spacing of immediately adjacent sheet metal strips, the connector members being securely connected at both ends with adjacent sheet metal strips, and respective connector members being web-shaped and provided in the peripheral direction of the drum, with at least one bore for at least one screw and/or similar attachment element provided with a thread, and connected to the two adjacent sheet metal strips or connector members; said transport member being provided with an additional perforated sheet metal cylindrical jacket arranged beneath the sheet metal strips.

A device of the type provided with sheet metal strips is known from DE 38 21 330 A1 and corresponding U.S. Pat. No. 4,912,945, the disclosure of which is incorporated herein by reference. It has the unsurpassed advantage that it is extremely permeable to air without thereby reducing the stability of the drum. Without having recourse to a welded construction, the sheet metal strips extending longitudinally across the drum are securely connected around the drum by means of the screw connection, preferably provided here, of the connector members extending in the peripheral direction. The disadvantageous microstructural changes in the metal during the manufacture of the otherwise necessary welded seams are avoided in this screwed structure.

Practice has shown that, particularly in the case of extreme drum lengths, and even in the case of the entailed small drum diameters, the air velocity in the center of the drum towards the fan becomes extremely high. In addition, the surface stresses on the drum which occur, depending on the density of the material to be treated, have an effect on the precision of rotation of the drum.

SUMMARY OF THE INVENTION

An object of the invention is to provide a screen drum with this particular type of construction in such a way that the extreme degree of permeability to air is retained, yet uniformity of the direct flow of the drum over the length thereof is increased. Furthermore, a measure is undertaken in order to retain the original precision of rotation of the drum in a permanent manner even under extreme stresses.

In fulfillment of this purpose, the invention proposes that a sheet metal cylindrical jacket provided with apertures is disposed parallel over the entire length of the drum radially inwards beneath the inner edges of the sheet metal strips.

In order to increase the dynamic pressure in front of the treatment chamber, it is known to dispose a pressure or screen cover, which ensures distribution of the air flowing in from the fan along the working width of the drum. It is recognized that this pressure cover, in view of the high degree of permeability to air of the screen drum construction of this type, is insufficient to generate a uniform direct flow. It is not meaningful to increase the dynamic pressure in front of the screen drum by smaller openings in the pressure cover, and thus possibly to render more uniform the distribution of the inflowing air, as this impairs the drying performance of the drum too much. In accordance with the present invention, while retaining the drum construction and thus the extreme degree of air permeability of the drum, the improved device generates a dynamic pressure on the other side of the contact surface for the textile material or the like, by means of an additional perforated sheet which is intended to be formed as a perforated sheet metal cylindrical jacket. This sheet metal jacket, extending over the entire working width, should be disposed preferably directly in contact with the inner edges of the sheet metal strips extending along the drum. This has the advantage that the air volume in the inner jacket is not further reduced when there are small drum diameters. This is of importance with respect to the air velocities arising there in the direction of the fan and with respect to the diameter to be constructed for the intake nozzle of the fan. A further advantage is gained by this additional jacket in that now the precision of rotation is permanently stabilized.

It is known to increase the air flow resistance by means of a second screen drum inside a drum carrying the material, in order to avoid having to cover the lateral strips of the drum, which are not covered by the now narrower textile material, by means of a separate sheet or cloth. This known construction, however, has no relationship to the present invention because in the invention, the important factor is the flow velocity in the permeable drum and the precision of rotation of the permeable drum of this type.

In a device smaller to that of the type in which however, only one threaded element extends over the height of the sheet metal strip, and thus also only one bore is provided in the sheet metal strip, the overall construction may be formed in a simpler and therefore more cost-effective way, if the respective connector members are formed by a tube through which only one threaded element is pushed over the height of the sheet metal strips, and then the additional sheet metal jacket provided with apertures is additionally disposed radially inwards beneath the inner edges of the sheet metal strips, concentric along the entire length of the drum. In order that the respective tubes, each cut with parallel ends, sit exactly at the bore in the sheet metal strip introduced radially exactly from the center line or longitudinal axis of the drum, the contact point of on the sheet metal strips for the end sides of the tube are to be formed parallel to an adjacent surface of the sheet metal strip. This is effected by a milled recess in the surface at least in the external diameter of the tube, being aligned with increasing depth in a radial inward direction. In this way, the contact surfaces of the tube are parallel to one another even when the sheet metal strips are radial and thus diverge.

BRIEF DESCRIPTION OF THE DRAWINGS

An embodiment of the device according to the invention is shown by way of example in the accompanying drawing, wherein.

Figure 1:
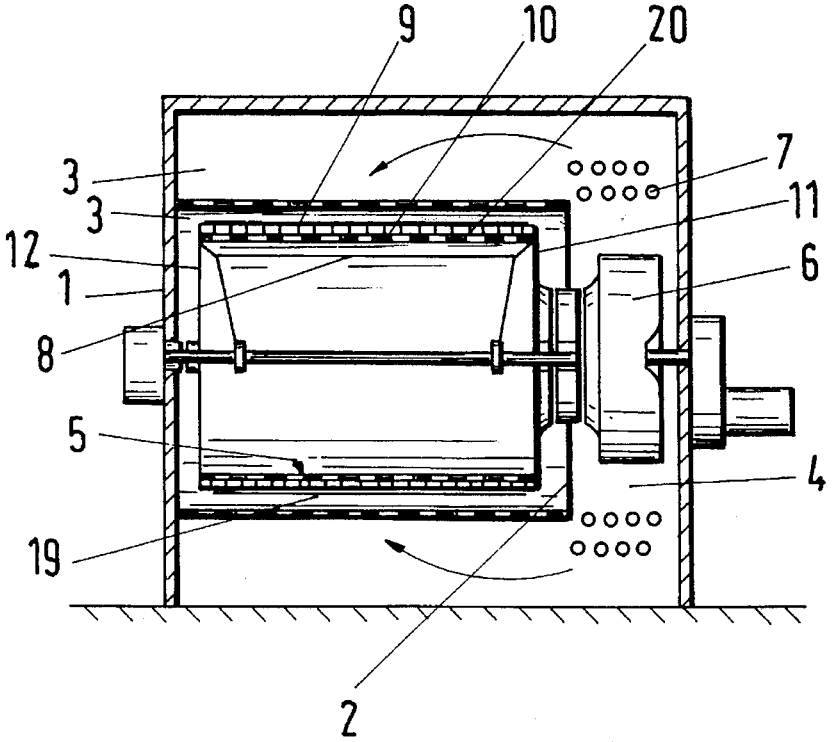
FIG. 1 is a longitudinal section through a screen drum device whose transport member in this case comprises a strip shaped sheet metal structure with wire gauze on the outside and an additional perforated sheet metal cylindrical jacket on the inside.

The screen drum device according to FIG. 1 has an arrangement of elements corresponding substantially to that, for example, according to the device shown in EP 0 315 961 A1.

A screen drum device basically comprises an approximately rectangular casing 1, subdivided by an intermediate partition 2 into a treatment chamber 3 and a fan chamber 4. A transport member including the screen or permeable drum 5 is mounted to rotate in the treatment chamber 3, and a fan 6 is mounted concentrically therewith to rotate in the fan chamber 4. The fan chamber may also be disposed in a fan casing (not shown here) and separate from the screen drum casing 1. In any case, the fan subjects the interior of the drum 5 to a suction draft. The drum construction in a wet-treatment device which may also serve only to evacuate liquid from the material transported on the drum, is also the subject-matter of the invention.

There are disposed, according to FIG. 1, above and below the fan 6, respective heating units 7, each comprising tubes through which heating medium flows. The screen drum, in the region not covered by textile material 19, is internally covered by an inner screen cover 8 which prevents the suction draft from acting on this region. The effective outer periphery of the screen drum 5 is formed by a sheet metal strip structure to be described hereinafter with reference to FIG. 2. This structure is externally surrounded by a fine-meshed screen 9, which is held under tension at the end or sides of the drum at the two bases or end sections 11, 12.

Figure 2:
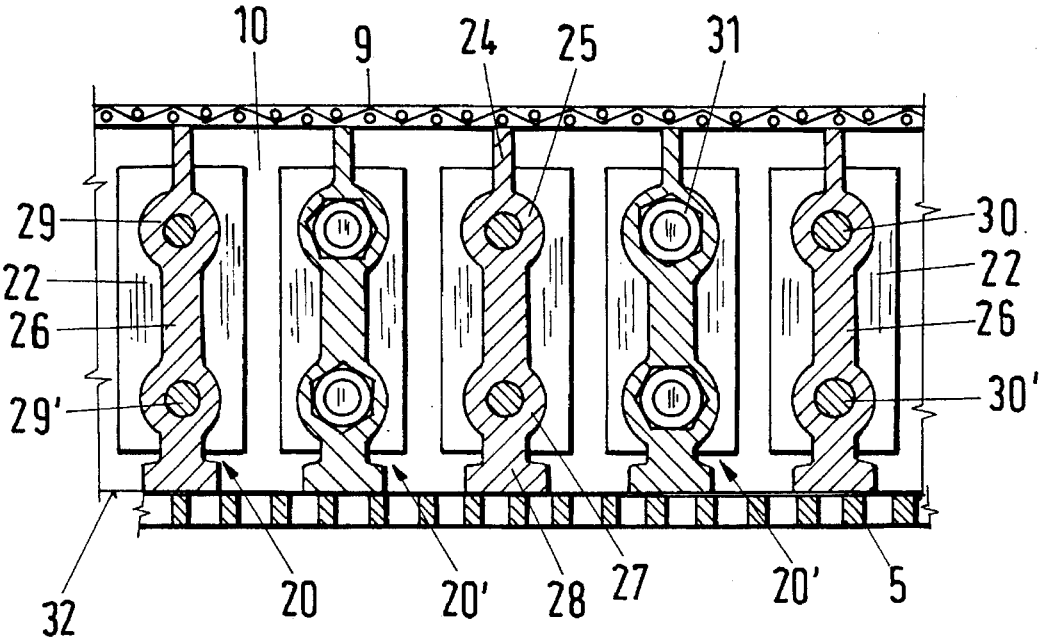
FIG. 2 is an enlarged view showing the transport member of this screen drum device in the same section as FIG. 1.

The sheet metal strip structure comprises radially-aligned sheet metal strips 10, whose radially-aligned height can be seen from FIG. 2. Thus the screen-like covering 9 contracts only the radially outwardly disposed edges of the sheet metal strips 10. The sheet metal strips 10 are secured at a specific spacing next to one another on the two bases 11, 12 by screws not shown. In order that this spacing is fixed over the width of the drum, connector members serving as spacers and generally indicated by reference numeral 20 are provided, connected by threaded elements, e.g., bolts or rods 29, 29', 30, 30', to the sheet metal strips 10. Instead of the two threaded elements shown per connector member, only one element may be used.

According to FIG. 2, the connector members 20, 20' have on their contact surface with the sheet metal strips 10, a rectangular flange 22. The radially outwardly-extending area of the connector member 20 is provided by the web 24, upon which screen 9 may also rest. Radially inwardly, the connector member 20 has a widened foot 28, while the remaining region 26 of the connector member, except at the level of the screw apertures 25, 27, is of narrow cross-section. Interconnection of the connector member 20 is effected by rods 29, 29' and 30, 30' with threads at least one both ends, upon which the nuts 31 are screwed within a connector member 20'.

Figure 3:
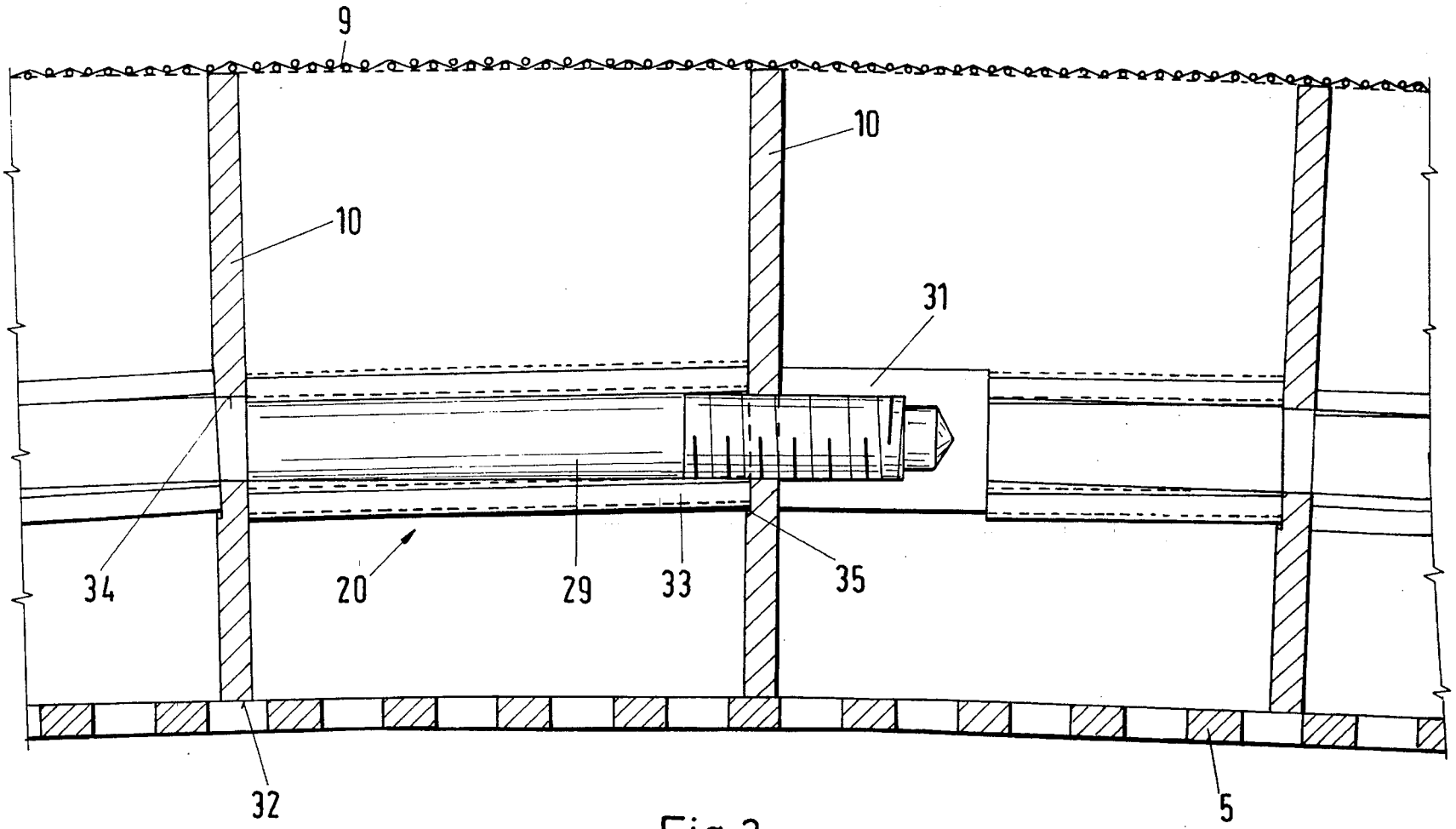
FIG. 3 is an enlarged view showing the transport member of the screen drum device, in section vertically to that according to FIG. 1 or 2, with only one connector member and only one threaded element over the height of the sheet metal strip.

FIG. 3 shows a further embodiment in which the sheet metal strips 10 are interconnected by connector members 20" which are disposed approximately in the center of the radial height of the sheet metal strips 10. These connector members comprise a tube 23, through which there extends a threaded element 29. The tube bears, with its end faces aligned parallel to one another, on the two adjacent surfaces of the sheet metal strips 10 at the level at which the bores 34 are disposed for passage of the element 29 through the sheet metal strips 10. The sheet metal strips 10 are aligned radially. Depending on the outer diameter of the drum 5, the sheet metal strips diverge to a greater or lesser degree at the outer circumference. In order to compensate for this difference in dimension in the contact of the tubes 33 on the sheet metal strips 10, a milled recess 35 corresponding to in surface to the diameter of the tube 33, and deepening radially inwards, is provided level with the bore 34 on one side of a sheet metal strip 10. The inclination of the milled recess corresponds to the divergence of the sheet metal strips 10, or is of such a construction that the contact surfaces of the tube 33 on the adjacent sheet metal strips 10 are aligned parallel to one another.

Naturally, the sheet metal strips 10 could also remain in an unaltered smooth or non-perforated state, and the tubes could be correspondingly milled to a slant on one end surface; this, however, provides problems during assembly of the drum. As the elements 29 while they are tightened are bent in the rounding of the drum 5, the respective tube is displaced by small degree, which is indicated by the dotted line.

The construction shown in FIG. 3 is more cost-effective as compared to that in FIG. 2, and yet is robust. The constructions shown in FIGS. 2 and 3 may be used separately on one drum or also in common on one drum. A particularly meaningful combination is provided if stray fluid currents at the edge of the drum are to be prevented. This is the case when a narrower textile material 19 is in contact with the drum and a lateral covering of the drum covers the portion of the drum not covered by material from the air inflow. If there are then no separating surfaces between the wire gauze 9 and sheet metal cylindrical jacket 40, the air evacuated on the internal side of the drum flows into the ducts between the sheet metal strips, leading to pressure losses. Therefore web-shaped parts 24, 25, 27, 28 or similar constructions are of advantage on the end or sides of the drums.

This screen drum jacket structure arising from FIGS. 2 or 3 is supplemented by an additional sheet metal cylindrical jacket 40. This normally perforated sheet metal jacket 40 extends on the internal side of the sheet metal strips 10 and abuts on their inner edges 32. The free direct flow surface of the drum construction is not impaired by this sheet metal jacket, yet its presence increases the uniformity of the direct flow along the length of the drum device, and the bending resistance of the resulting drum structure is improved. Naturally in this case the internal cover 8 abuts on the sheet metal jacket 40, which entails a further advantage in connection with an improved seal for the region of the drum not covered by fiber-containing material 19. The sheet metal jacket 40 may be secured by threaded elements, e.g., screws, etc., to the bases of the drum 5 or by welds to the strips 10.

What is claimed is:

1. A device for direct-flow treatment of fiber-containing material with a fluid treatment agent circulated therein, which comprises a transport member comprising a permeable drum rotating about its longitudinal axis, said drum having bases on its ends and being under a suction draft for effecting circulation of the fluid treatment agent, said transport member being covered on its periphery with a screen covering, sheet metal strips extending rectilinearly and unbent from one base to the other base between the bases of the drum, the widths of said strips extending in a radial direction, one-piece connector members being uniformly disposed between the sheet metal strips over the length of the drum having a width corresponding to a required spacing of the immediately adjacent sheet metal strips, said connector members being securely connected at both ends with the adjacent sheet metal strips, respective connector members being web-shaped and provided in the peripheral direction of the drum with at least one bore for at least one threaded element which may be connected to the two adjacent sheet metal strips or connector members, and an additional sheet metal jacket having apertures in its periphery and arranged with its longitudinal axis in parallel to the longitudinal axis of the permeable drum radially inwards beneath inner edges of the sheet metal strips.

2. A device for direct-flow treatment of fiber-containing material with a fluid treatment agent circulated therein, which comprises a transport member comprising a permeable drum having a longitudinal axis and bases on its ends, said drum being under a suction draft, said transport member being covered on its periphery with a covering, sheet metal strips extending rectilinearly and unbent between the bases of the drum, the widths of said strips extending in a radial direction, one-piece connector members being uniformly disposed between the sheet metal strips over a length of the drum, said connector members having a width corresponding to a required spacing of the immediately adjacent sheet metal strips, and being securely connected at both ends to the adjacent sheet metal strips with threaded elements, and above the height of the sheet metal strips in each case only one bore is provided in the sheet metal strip, the respective connector members comprising a tube, through which only one threaded element may be pushed over the height of the sheet metal strips, and an additional sheet metal jacket having apertures is disposed radially inwards beneath internal edges of the sheet metal strips with a longitudinal axis in parallel to a longitudinal axis of the permeable drum.

3. A device according to claim 1 or 2, wherein the sheet metal jacket is perforated over its entire length.

4. A device according to claim 3, wherein the sheet metal jacket abuts directly on the internal edges of the sheet metal strips.

5. A device according to claim 2, wherein the sheet metal strips, level with the single bore for the single threaded element each has a milled recess which increases in depth in a radial inward direction, for contact with one end side of the tube.

6. A device according to claim 5, wherein an inclination of the milled recess is arranged so that the milled surface is aligned parallel to a wall disposed opposite of the adjacent, radially-aligned sheet metal strip.

7. A device according to claim 5 or 6, wherein two ends of the tube are cut parallel to one another.

* * * * *